US007891027B2

(12) United States Patent
Mooney

(10) Patent No.: US 7,891,027 B2
(45) Date of Patent: Feb. 22, 2011

(54) DRAIN VENT SEAL

(76) Inventor: Robert Blu Mooney, 633 Atwood St. NE., Grand Rapids, MI (US) 49503

( * ) Notice: Subject to any disclaimer, the term of this patent is extended or adjusted under 35 U.S.C. 154(b) by 346 days.

(21) Appl. No.: 12/144,902

(22) Filed: Jun. 24, 2008

(65) Prior Publication Data

US 2009/0094732 A1 Apr. 16, 2009

Related U.S. Application Data

(63) Continuation-in-part of application No. 11/882,469, filed on Oct. 11, 2007, now abandoned.

(51) Int. Cl.
*E03D 9/00* (2006.01)

(52) U.S. Cl. ..... 4/255.07; 4/255.01

(58) Field of Classification Search ... 4/255.01–255.12, 4/293; D32/14, 35

See application file for complete search history.

(56) References Cited

U.S. PATENT DOCUMENTS 872,746 A 12/1907 Peterson
952,240 A * 3/1910 Deming ..... 4/255.07
1,240,132 A * 9/1917 Gleason ..... 4/255.07
2,036,614 A * 4/1936 Tharp ..... 4/255.07
3,336,604 A 8/1967 Lacey et al.
5,497,516 A * 3/1996 Irwin ..... 4/694
7,058,993 B2 6/2006 Nasco
7,062,800 B1 * 6/2006 Alfred ..... 4/255.11

* cited by examiner

*Primary Examiner*—Gregory Huson
*Assistant Examiner*—Janie Christiansen

(57) ABSTRACT

A seal assembly for a drain vent is provided to direct the pressure exerted by a plunger to the face of a drain clog rather than escaping through the drain vent. The seal assembly of the invention comprises a tubular body having a first closed end and a second open end to define a substantially rigid a cup-like structure or cavity. A sealing member concentric with a longitudinal axis of the tubular body is attached to the second open end of the tubular body to form a seal against a surface containing the drain vent. A handle is attached to the closed end of the cup-like structure and extends away from the closed first end of the tubular body to provide a mechanism for the user to hold the sealing member against the surface containing the drain vent during the plunging process.

17 Claims, 7 Drawing Sheets

FIG. 10
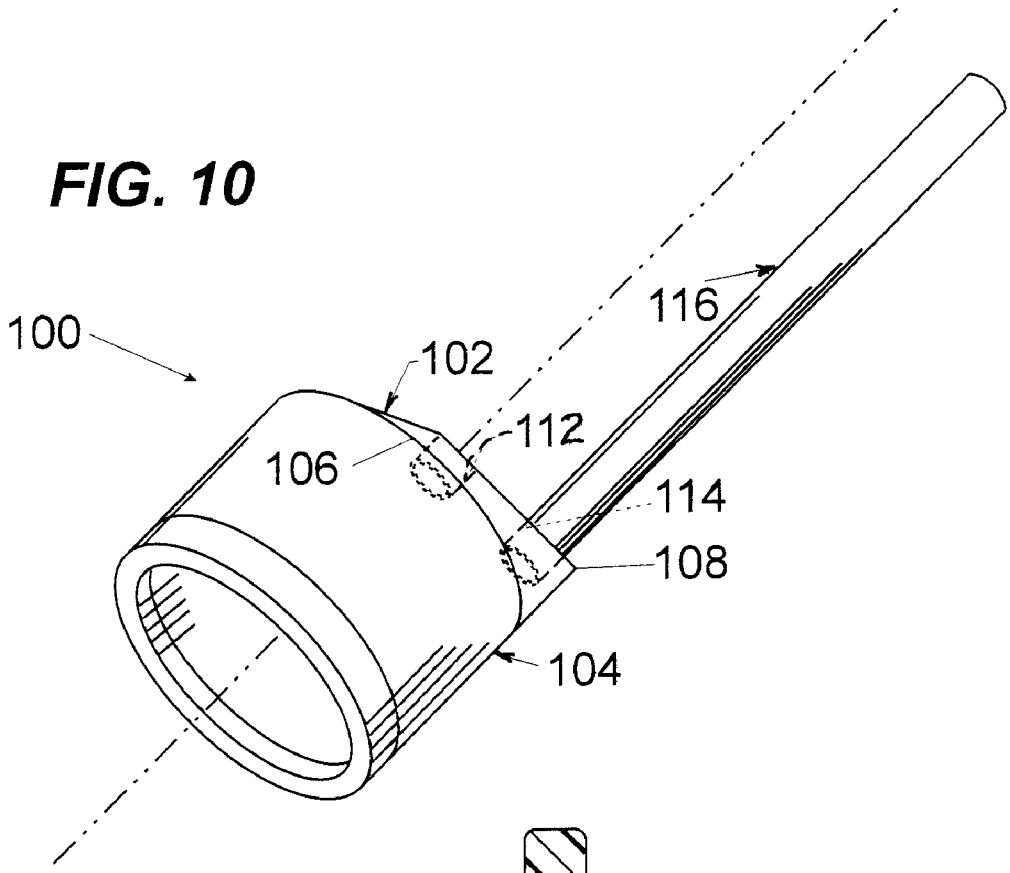
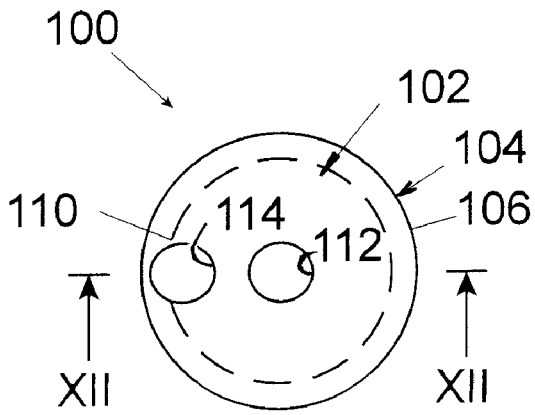
FIG. 11
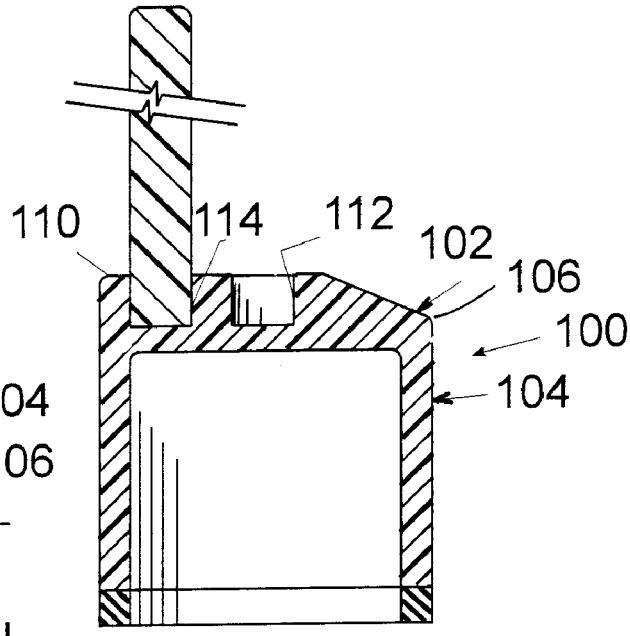
FIG. 12

FIG. 13
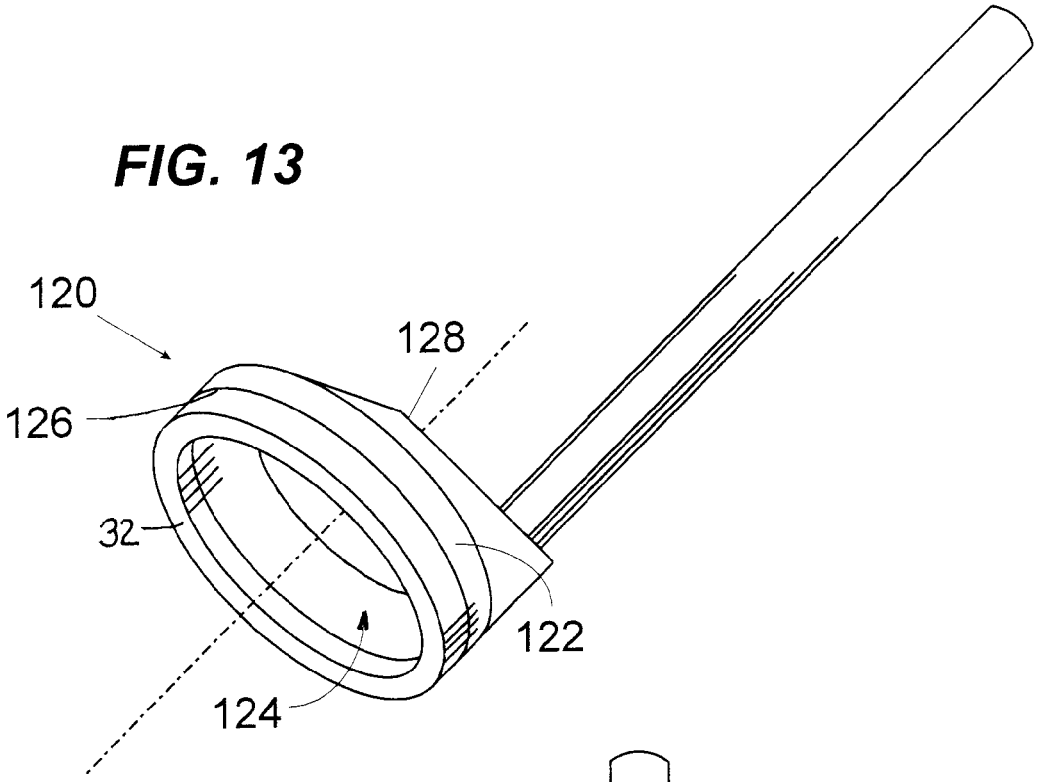
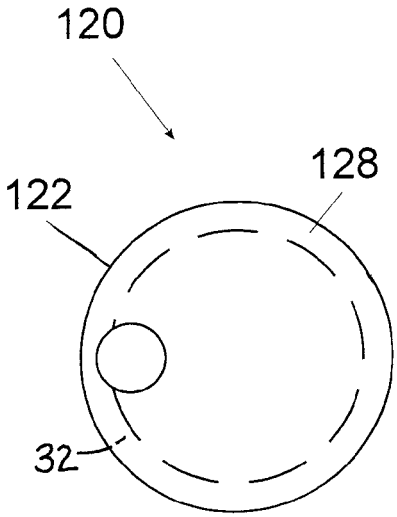
FIG. 14
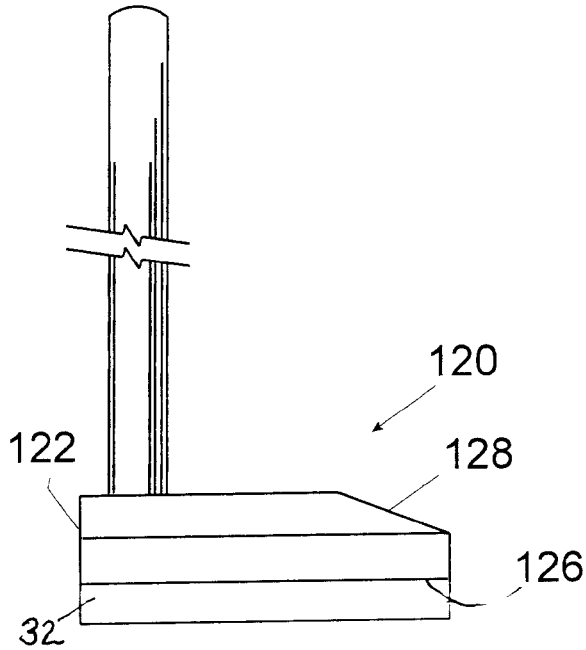
FIG. 15

DRAIN VENT SEAL

CROSS REFERENCE TO RELATED APPLICATIONS

This is a continuation-in-part application filed pursuant to 37 C.F.R. 1.53(b) and claims priority under 35 U.S.C. §120 to prior filed U.S. non-provisional patent application Ser. No. 11/882,469 filed Oct. 11, 2007 now abandoned.

STATEMENT REGARDING FEDERALLY SPONSORED RESEARCH OR DEVELOPMENT

Not Applicable

BACKGROUND OF THE INVENTION

1. Field of the Invention

This invention relates to drain and drain vents and more particularly to a device for seating drain vents. More specifically the invention is a tool used in conjunction with a conventional plunger for sealing drain vents to more efficiently force fluid in a direction to clear debris from a drain trap.

2. Description of the Related Art

Every year thousands of consumers are faced with clearing a clogged drain in a kitchen or bathroom sink, a bath tub or laundry tub. An unknown number of these consumers are turning to chemical solvents and corrosive agents for dissolving debris clogging the drain. When effective these solvents flow down the drain and into the waste water treatment system and eventually into the environment, contributing to the world's pollution. There are more "green" options available for cleaning debris from drain pipes.

Traditionally, before the advent of caustic chemical drain cleaners and solvents, consumers often used a plunger. The plunger is placed over the opening to the drain to form a seal. Depression of the plunger collapses a cavity above the drain, increasing the pressure on one side of the clog. With effort, the repeated pressure changes break-up the debris with the U-shaped drain trap, and permit the fluid in the drain to clear the debris and allow the drain to flow. However, with improvements to modern sinks and bathtubs and specifically the addition of drain vents in the hardware, plungers are less effective, shifting consumer dependence upon chemical removers. This shift occurred primarily because users could no longer obtain sufficient pressure on one side of the clog due to the leaking of the air out the drain vent. User's have had no sure way of sealing those vents when using a plunger.

There has been a long felt yet unresolved need to provide a tool that can be used in conjunction with a conventional plunger or other pressurized fluid device (i.e., cans of compressed air) to seal the drain vents of tubs and sinks to direct the full force and pressure of the plunger to one side of the debris clogging the drain.

SUMMARY OF THE INVENTION

The invention described below generally overcomes all of the disadvantages of what was done prior to the invention. The invention reduces the need for chemical solvents and caustic based compounds to unclog drains. This reduces in less pollution and creates a more environmentally friendly solution.

A drain vent seal device is provided to form a generally air-tight seal over a drain vent. The seal device includes a cup having a seal on an open end of the cup. The invention is designed and intended to fit over and substantially seal a drain vent used in a bathtub, tub, sink, and the like. With the cup in place and held in position over the vent, a plunger or other device may be used to rapidly change the pressure within the drain to mechanically break up and loosen the clog.

According to another form of the invention, the seal for the drain vent is provided for creating a substantially fluid-tight seal around the drain vent while using a plunger or other device is used to changing the fluid pressure on one side of the clog blocking the drain trap. More specifically the invention comprises a rigid member or cup defining a cavity wherein an open end of the cavity includes a flexible lip. The cavity is placed over the drain vent such that the flexible lip seals against a surface surrounding the drain vent to prevent air or other fluids from escaping from the drain vent when pressure is applied to the drain trap.

In yet another form of the invention a seal for a drain vent, comprises a tubular body having a first end closed end and a second open end for forming a rigid cavity within the tubular body. A sealing member is provided that is concentric with a longitudinal axis of the tubular body and is attached to the second open end of the tubular body. The sealing member forms a seal against a surface containing the drain vent. The tubular body and sealing member may be held in position by a handle attached to and extending away from the closed first end of the tubular body.

In yet another form of the invention, the seal for a drain vent includes a recess extending into an exterior surface of the first closed end of the tubular body for receiving the handle. In one embodiment, it is envisioned that the tubular body has a Young's Modulus of Elasticity greater than that for the sealing member so that the tubular body places the sealing member into intimate contact with the surface containing the drain vent to form a substantially fluid-tight seal.

In yet another form of the invention, the tubular body may take on one or more different cross-sectional shapes to form the cavity. For example it is anticipated that the tubular body may have a right circular cylindrical shape, a multi-faceted polygonal shape such as an octagon or hexagon, a square, or a triangle.

According to another form of the invention, the handle may take on any one of a number of configurations so that it is convenient for the user to maintain the seal over the drain vent. The handles configurations include those parallel to a longitudinal axis of the tubular body including concentric and off-axis configurations. It is further envisioned that transverse handle orientations may be acceptable. In its broadest form, it is envisioned that no handles be provided: the user simply grasps the close end of the cup-like body to hold the seal in position.

One advantage provided by the invention, described in greater detail below, is that the pressurized air or other fluid applied to the drain trap to break the clog is prevented from escaping through the drain vent and ensures that most of the force is directed toward the clogged drain trap to remove the clog. Another advantage of the instant invention over the prior art is that it greatly improves the efficiency and effectiveness of the pressure generated by the plunger or other device than if the drain vent remained unsealed. Last, but not least, another advantage of the instant invention is that it has the potential for greatly reducing the volume of potentially damaging drain cleaning solvents and cleaners used by consumers to clear clogged drains. The reduction in such chemical drain cleaners and solvents will reduce the amount of chemical pollutants put into our water systems and treatment plants.

These and other advantages of the instant invention will become understood and readily apparent to a person of ordinary skill in the art after reading the following detailed description in combination with reference to the following drawing figures.

DESCRIPTION OF THE DRAWING FIGURES

FIG. 10 is an oblique view of yet another form of the seal for a drain vent comprising the invention;

FIG. 11 is an end view of the invention shown in FIG. 10;

FIG. 12 is a cross-sectional view of the invention taken along line XII-XII shown in FIG. 11;

FIG. 13 is an oblique view of vet another form of the seal for a drain vent comprising the invention;

FIG. 14 is an end view of the invention shown in FIG. 13;

FIG. 15 is a cross-sectional view of the invention taken along line XIV-XIV shown in FIG. 14;

DETAILED DESCRIPTION OF THE INVENTION

Figure 3:
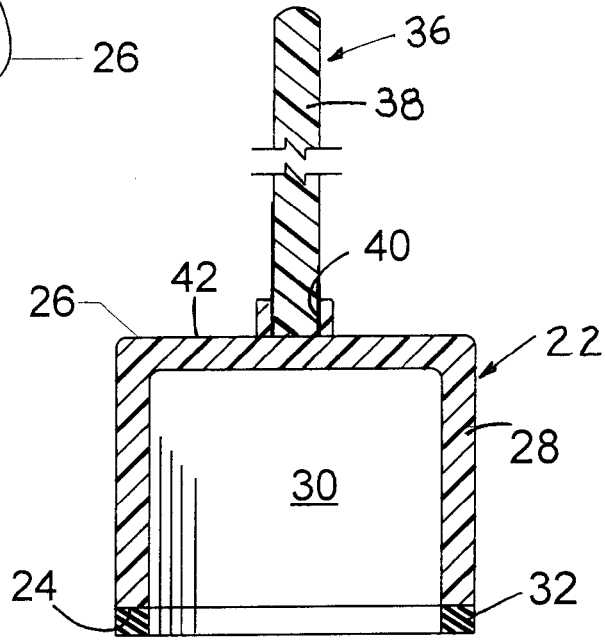
FIG. 3 is a cross-sectional view of the invention taken along line III-III shown in FIG. 2.

For purposes of the following description, the terms "upper," "lower," "right," "left," "rear," "front," "vertical," "horizontal," "inclined," and derivatives thereof shall relate to the invention as oriented in FIG. 3. However, it is to be understood that the invention may assume various alternative orientations and component spacing, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. Moreover, in reference to the drawing figures, like numerals will be used in the different views to illustrate similar components Referring to the drawing figures, the different embodiments shown therein generally illustrate a device for sealing a drain vent for and for use in conjunction with a plunger or other tool that changes the pressure on one side of a clog in a drain. The seal assembly may be used to seal drain vents commonly used in bathtubs, tubs, and sink drain overflow vents while a plunger or other device is being used. The seal assembly substantially increases the efficiency and effectiveness of breaking up the debris in the drain trap by preventing the escape of the fluid through the drain vent, overflow gate, or secondary drain. The invention also virtually eliminates the need for environmentally unfriendly chemical solvents and caustic compounds used to clean drains and ultimately introduced into the worlds waste water treatments facilities.

Figure 1:
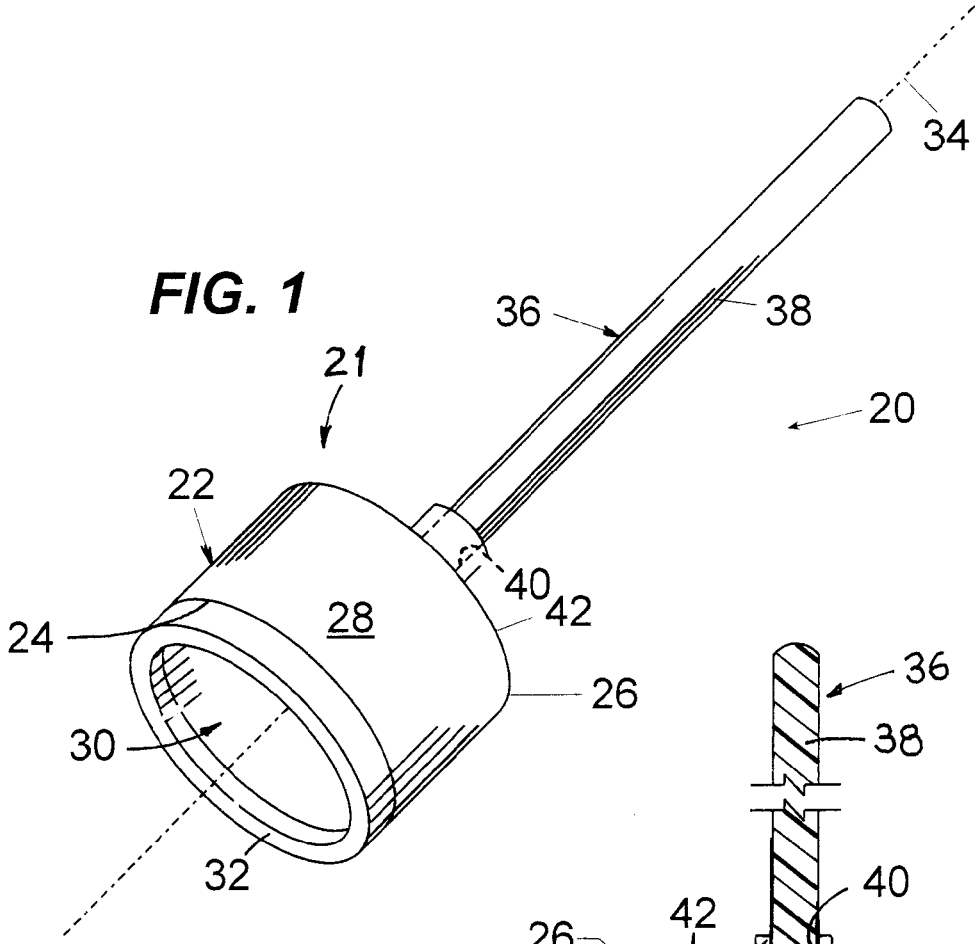
FIG. 1 is an oblique view of one form of the seal for a drain vent comprising the invention.
Figure 2:
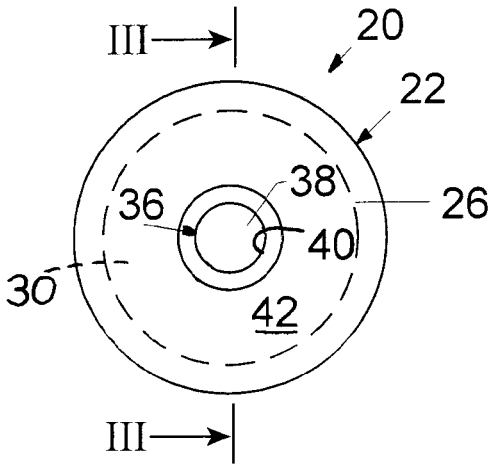
FIG. 2 is an end view of the invention shown in FIG. 1.

According to one form of the invention illustrated in FIGS. 1-3, a seal assembly 20 for a drain vent comprises a head 21 defined by a generally tubular body 22 having a first closed end 26 and a second open end 24. The tubular body 22 is shown as being substantially cylindrical, although a polygonal-shape or faceted shape would also be acceptable. It is envisioned that the shapes may range from cylindrical to triangular in cross section. The tubular body 22 may be made from any one of a number of materials including metals, plastics including thermoplastics and thermosetting resins, and glass reinforced resins such as oriented and random oriented fiber materials such as fiberglass and the like. A preferred quality and characteristic of the material is that it be substantially impermeable to fluids. Any one of a number of materials may be used to form the tubular body 22 so long as the material can provide a rigid sidewall 28 to define a cavity 30 between the first 26 and second 24 ends of the body 22 to form a head. In the embodiment shown in FIGS. 1-3 the head is generally in the form of a right-circular cylinder where the second closed end 26 is generally at a right-angle to the cylindrical sidewall 28. A sealing member 32 concentric with a longitudinal axis 34 of the tubular body is attached to the second open end 24 of the head 21 to form a seal against a surface containing the drain vent. According to one form of the invention, the sealing member has a modulus of elasticity less than that of the tubular body 22 so that the sealing member is more flexible and can be deformed against the surface to be sealed. The sealing member 32 may be made from any one of a number of materials including rubber, cork, closed-cell foam, and a host of synthetic polymeric materials. Other materials may also be suitable so long as they are impermeable, flexible, and can be attached to the end of the tubular body 22 to create a seal with another surface.

The seal assembly 20 also includes a handle 34 attached to and extending away from the closed first end 26 of the head 21 to be grasped by a user for holding the sealing member 32 against the surface containing the drain vent during the operation and implementation of the invention. Any one of a number of handle arrangements may be designed for use in combination with the invention 20. According to one form of the invention, the handle 36 may be a solid or tubular and may be in the form of a rod 38 such as shown in FIGS. 1-3. Other handle configurations are envisioned such as T-shaped or C-shaped members extending from the head 21. Others may include bulbous knobs. In its simplest configuration, no handle is necessary and the user may simply grasp the closed second end of the head 21 if desired. Any handle 36 may be made from wood, metal, or a polymeric material such as polyvinylchloride or other material that offers a substantially rigid structure so that the user can manipulate the tubular body 22 into a desired orientation and for transferring pressure applied by the user for placing the sealing member 32 into sealing engagement with a specific surface.

In one particular form of the invention shown in the drawing figures, one end of the handle 36 may be received within a recess 40 formed in a nipple or extending into an exterior surface 42 of the first closed end 26 of the head 21 for receiving the handle. The recess 40 may have a tubular wall concentric with the longitudinal axis 34 of the tubular body 22. It is anticipated that any one of a number of anchoring mechanisms may be employed to hold the handle 36 within the recess 40 including mechanical fasteners such as pins, bolt, or screws, or the end of the handle may be threaded and received by corresponding matching threads formed in the wall of the recess. Alternatively it is envisioned that the handle end may be retained by a pressure fit of the material about the end of the handle.

Figure 4:
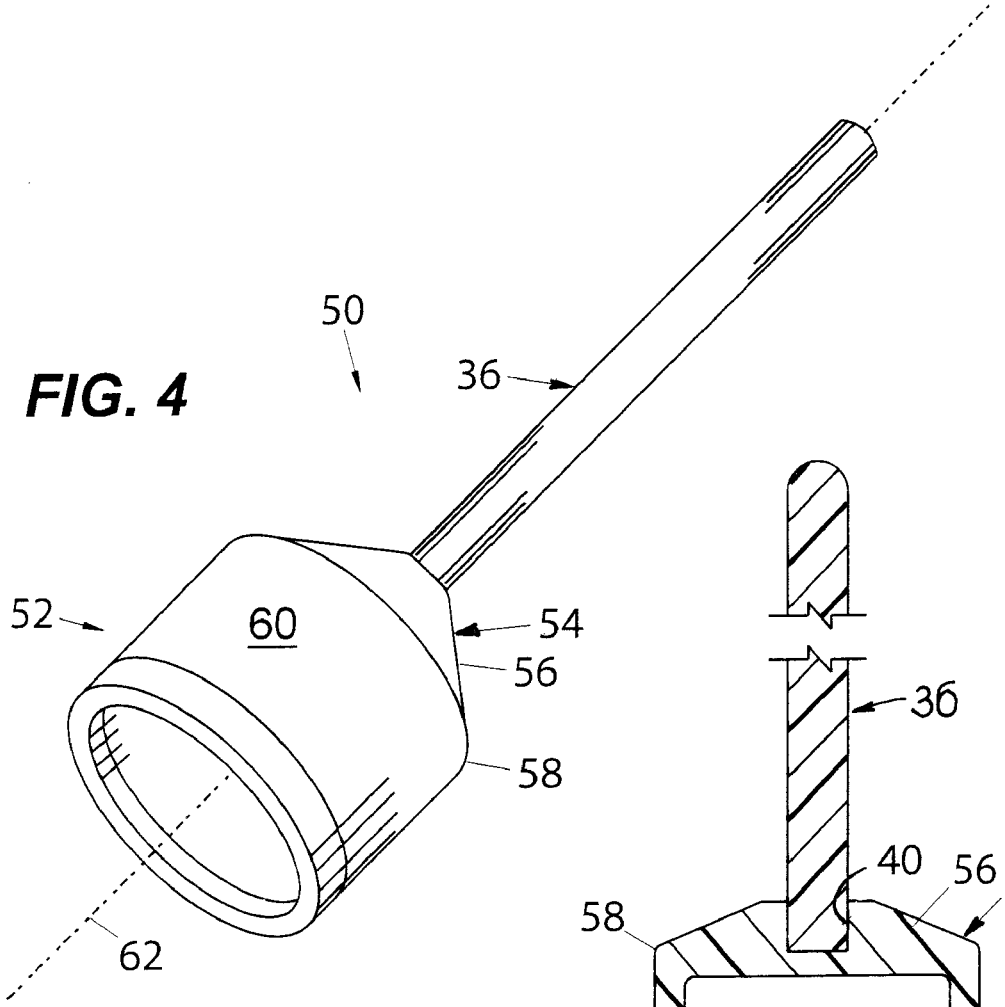
FIG. 4 is an oblique view of another form of the seal for a drain vent comprising the invention.
Figure 6:
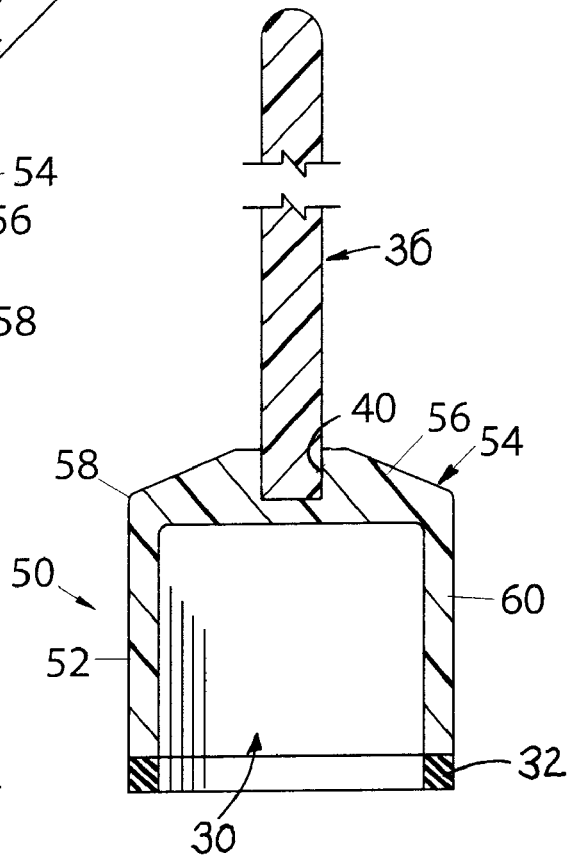
FIG. 6 is a cross-sectional view of the invention taken along line VI-VI shown in FIG. 5.
Figure 5:
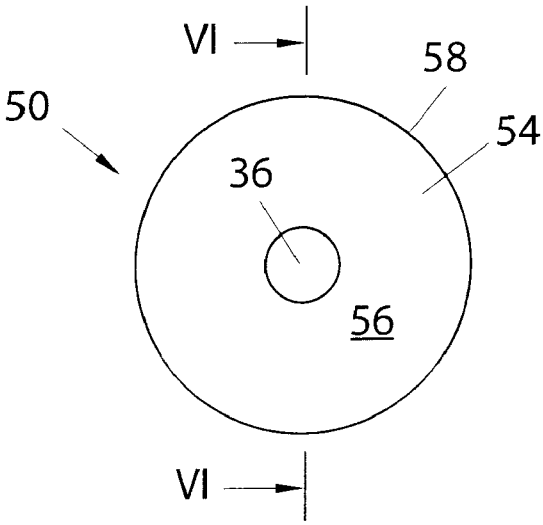
FIG. 5 is an end view of the invention shown in FIG. 4.

Another form of the invention 50 illustrated in FIGS. 4-6 is based upon substantially the same geometry described above but for the shape of the head 52. In the second embodiment of the invention 50, the second or closed end 54 of the head 52 is generally frusta-conical in form. A generally frusta-conical end wall 56 tapers from the peripheral edge 58 of the second end of the sidewall 60 toward an apex located along the longitudinal axis 62.

Figure 7:
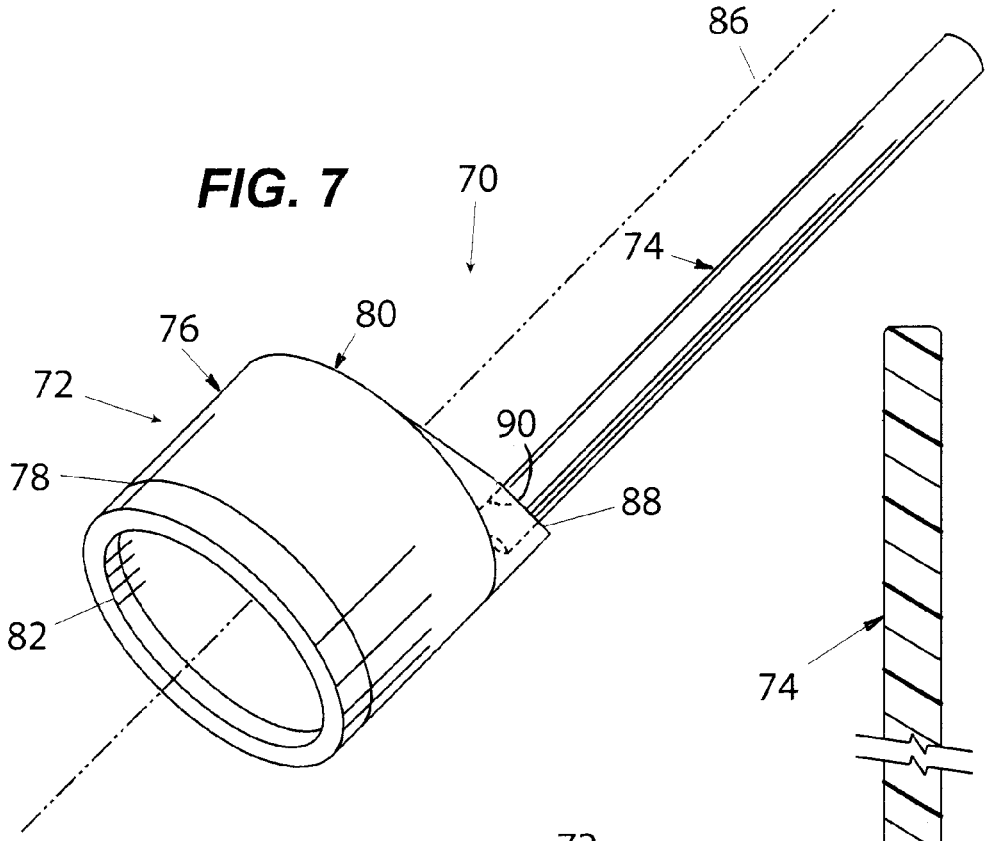
FIG. 7 is an oblique view of yet another form of the seal for a drain vent comprising the invention.
Figure 8:
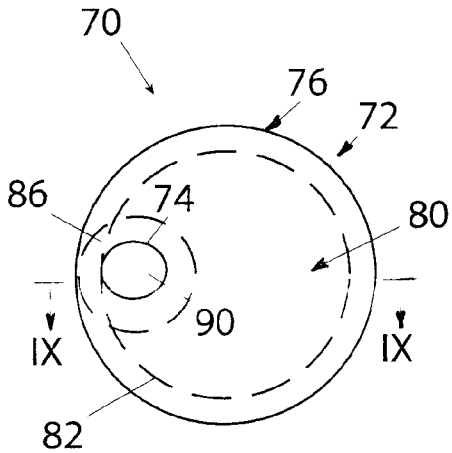
FIG. 8 is an end view of the invention shown in FIG. 7.
Figure 9:
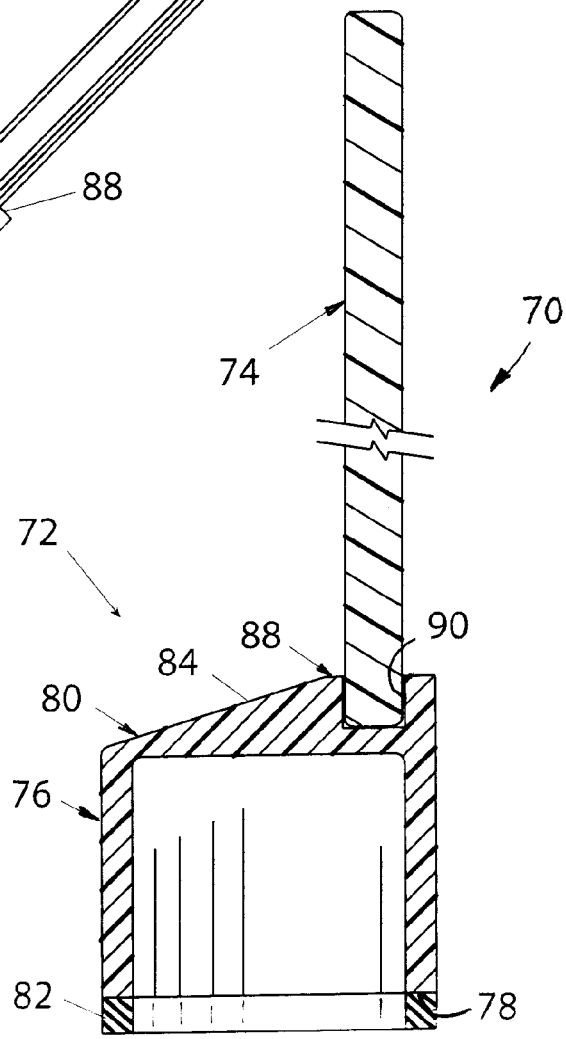
FIG. 9 is a cross-sectional view of the invention taken along line IX-IX shown in FIG. 8.

It is envisioned that other placements of the handle may be adopted particularly to avoid situations where the user encounters interference in using the invention with other tools such as plungers and the like. To accommodate for those instances it is envisioned that accommodation may be made to relocate the handle to a position parallel to the longitudinal axis of the invention, but off-axis. In particular the reader is directed to the forms of the invention shown in FIGS. 7-15. With specific reference to FIGS. 7-9, another form of the invention 70 is illustrated comprising a head assembly 72 and a handle assembly 74. The head assembly includes a cup-like body 76 of generally cylindrical shape having a first open end 78 and a second closed end 80. Attached to and concentric with the first open end 78 of the cup 76 is a sealing member 82 of the quality and character to that described above. The exterior surface 84 of the second and closed end 80 is also frusta-conical, but asymmetric such that the apex 88 is located offset from the longitudinal axis 86 of the invention. Disposed within the second end 80 of the cup 76 is a recess 90 located at the apex 88 and for receiving the handle assembly 74 such as described above.

FIGS. 10-12 illustrate a more universal embodiment 100 of the invention wherein alternative handle positions are available. In the embodiment 100, the second closed end 102 of the cup 104 tapers inwardly from the peripheral edge 106 of the second end 102 toward a table or plateau 108 forming the apex 110 of the second end 102. The table or plateau 108 has defined therein at least two recesses 112 and 114 for selectively receiving the end of the handle 116. One of the recesses such as 112 may be disposed proximate to or concentric with the longitudinal axis 118 of the invention. The second of the recesses such as 114 may be disposed off-axis or more aligned toward a peripheral edge 106 of the cup 104.

Figure 16:
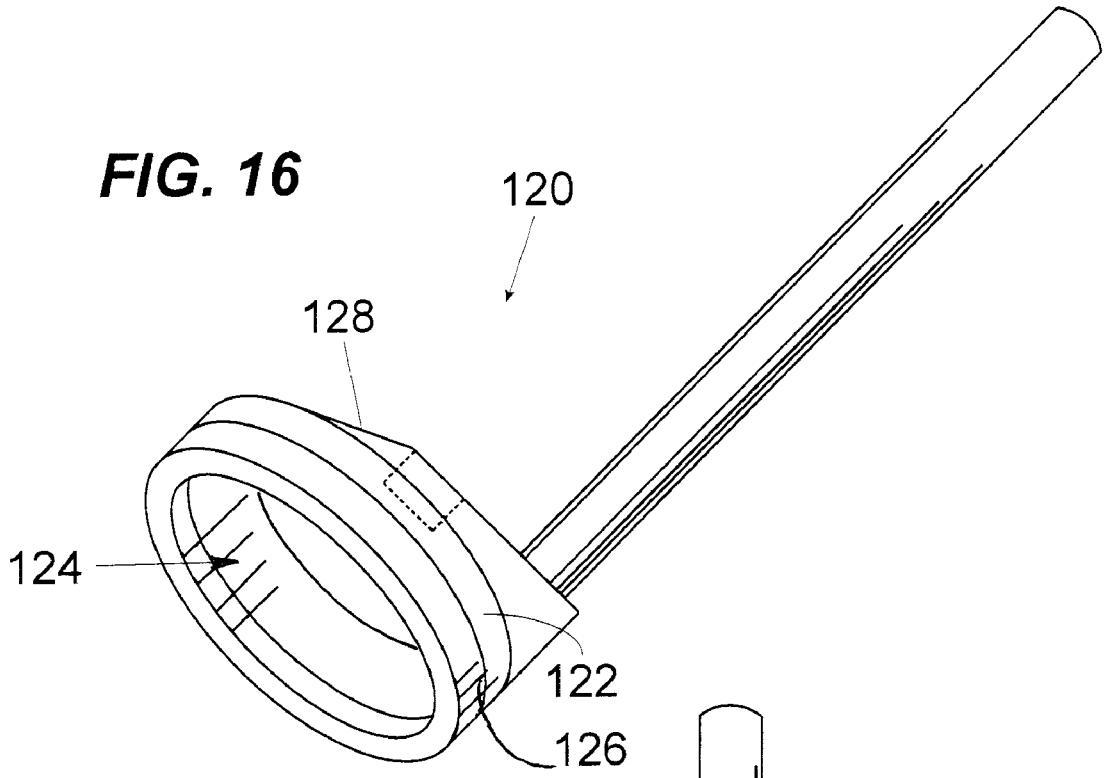
FIG. 16 is a oblique view of another form of the invention.
Figure 17:
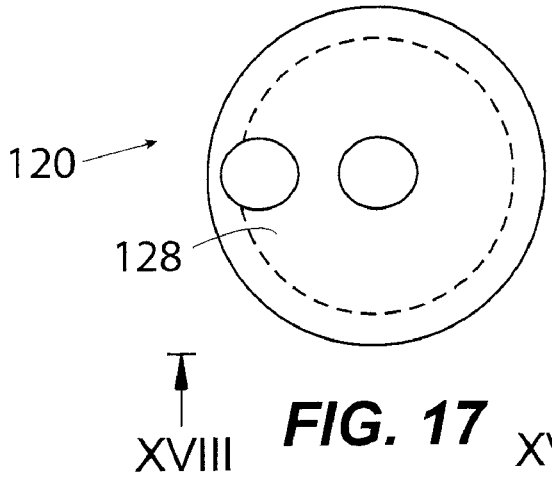
FIG. 17 is an end view of the invention shown in FIG. 16.
Figure 18:
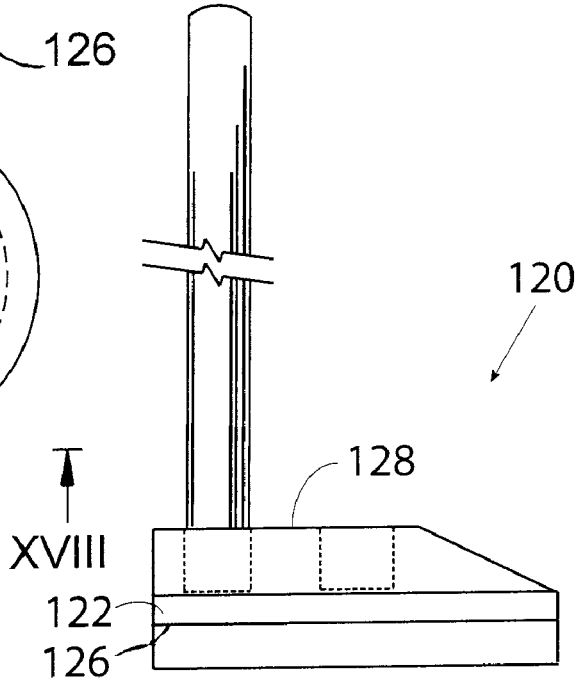
FIG. 18 is a cross-sectional view of the invention taken along line XVIII-XVIII shown in FIG. 17.

Other embodiments of the invention are depicted in FIGS. 13-18 to illustrate that the size of the cups, both in terms of diameter and in terms of depth, may vary, depending upon the desired application or requirement. For example it is envisioned that cups such as designated by numeral 120 in FIGS. 13-15 may have a reduced longitudinal dimension in terms of the height of the sidewalls 122 so as to create a smaller cavity 124 within the sidewalls and between the first open end 126 and the interior of the second closed end 128. FIGS. 16-18 are provided to illustrate the alternative accommodations of the handle locations as well. The same type of asymmetrical frusta-conical second end 130 described above to can provide sufficient material to permit the formation of a plurality of handle recesses 132 and 134 to permit the user to place the handle in the most desirable location during use.

Figure 19:
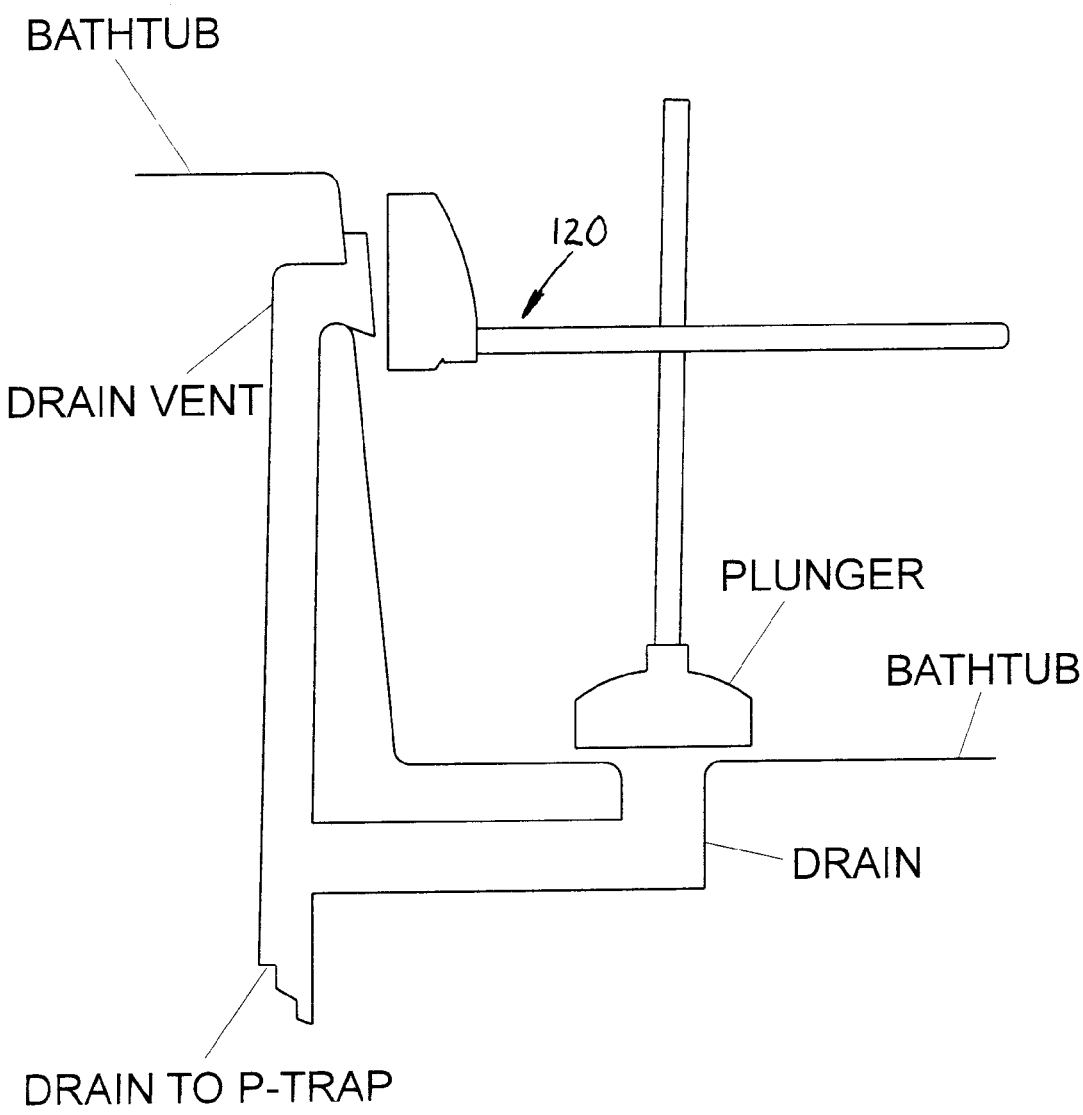
FIG. 19 is a schematic cross-sectional view of a vessel illustrating operation of the invention.

The best mode of using the alternative forms of the invention may best be understood by reference to FIG. 19. There a portion of a vessel 150 such as a sink or tub is depicted in a fragmentary cross-sectional view. The bottom 152 of the vessel 150 includes a drain 154 which is in fluid communication with a drain vent 156 that extends to an upper portion of the vessel 150. Both the drain 154 and the drain vent 156 are in turn in fluid communication with the downstream drain trap (not shown) where most clogs occur. If the drain vent 156 is not plugged, any plunging of the drain 154 will force any air pressure up the drain vent 156 to ambient. The pressure generated by the plunger is directed against the drain clog when the invention is placed such that the cup-like body of the invention is placed over the drain vent opening and sealed by the sealing member pressed against the sides of the vessel 150. As seen in the figure, it occasionally transpires that the handle of the plunger and the handle of the invention interfere with one another because it is not unusual for the drain and the drain vent to be vertically aligned. By initially placing the handle of the invention off-axis from the longitudinal axis described above, the handle of the invention can be rotated ninety-degrees to one side or other of the vertical plane and avoid any interference between the handles of the invention and the plunger.

The invention claimed is:

1. A seal for a drain vent, comprising: a tubular body having a first closed end and a second open end for forming a rigid cavity within said tubular body; a sealing member concentric with a longitudinal axis of said tubular body and attached to said second open end of said tubular body for forming a seal against a surface containing the drain vent; a handle and a recess extending into an exterior surface of said first closed end of said tubular body for receiving said handle; said handle and said recess being located peripherally with respect to said tubular body and spaced from said longitudinal axis of said tubular body, and said handle attached to said tubular body via said recess and extending away from said closed first end of said tubular body for holding said sealing member against said surface containing the drain vent.

2. The seal for a drain vent as defined in claim 1, wherein said tubular body includes a modulus of elasticity greater than that for said sealing member.

3. The seal for a drain vent as defined in claim 1, wherein said sealing member includes a modulus of elasticity lesser than that for said tubular body.

4. The seal for a drain vent as defined in claim 1, wherein said tubular body includes a polygonal-shaped tubular body.

5. The seal for a drain vent as defined in claim 1, wherein said tubular body includes a cylindrical-shaped tubular body.

6. The seal for a drain vent as defined in claim 1, wherein said tubular body is comprised of thermoplastic material.

7. The seal for a drain vent as defined in claim 1, wherein said tubular body is comprised of a thermosetting material.

8. The seal for a drain vent as defined in claim 1, wherein said tubular body is comprised of a metallic material.

9. The seal for a drain vent as defined in claim 1, wherein said tubular body is comprised of an oriented stand material.

10. The seal for a drain vent as defined in claim 1, wherein said tubular body is comprised of a random oriented strand material.

11. The seal for a drain vent as defined in claim 1, wherein said tubular body is substantially impermeable to fluids.

12. The seal for a drain vent as defined in claim 1, wherein said sealing member is substantially impermeable to fluids.

13. The seal for a drain vent as defined in claim 1, wherein said sealing member is substantially non-porous.

14. The seal for a drain vent as defined in claim 1, wherein said handle and said recess are parallel to said longitudinal axis of said tubular body.

15. The seal for a drain vent as defined in claim 1, wherein said recess includes a threaded interior wall.

16. The seal for a drain vent as defined in claim 1, wherein said handle is retained within said recess by a mechanical fastener.

17. The seal for a drain vent as defined in claim 1, wherein said handle is retained within said recess by compression of said recess about said handle.

* * * * *